United States Patent [19]

Stelben et al.

[11] 4,286,866

[45] Sep. 1, 1981

[54] BIAS VOLTAGE CONTROL FOR ELECTROPHOTOCOPIER MAGNETIC BRUSH

[75] Inventors: John J. Stelben, Greenwich; Kim E. Siladi, Danbury; George A. Herman, Jr., Brookfield; John E. Vesel, Stratford, all of Conn.

[73] Assignee: Pitney Bowes Inc., Stamford, Conn.

[21] Appl. No.: 117,889

[22] Filed: Feb. 1, 1980

[51] Int. Cl.[3] ..... G03G 15/00

[52] U.S. Cl. ..... 355/14 D; 355/3 DD; 355/3 CH; 355/14 CH

[58] Field of Search ..... 355/3 R, 3 DD, 3 CH, 355/14 R, 14 D, 14 CH, 3 BE, 16

[56] References Cited

U.S. PATENT DOCUMENTS

| | | | |
|---|---|---|---|
| 4,192,604 | 3/1980 | Koyama | 355/3 DD |
| 4,194,828 | 3/1980 | Hölz et al. | 355/3 DD |

*Primary Examiner*—Richard L. Moses

*Attorney, Agent, or Firm*—Lawrence E. Sklar; William B. Soltow, Jr.; Albert W. Scribner

[57] ABSTRACT

An improvement in an electrophotocopying machine utilizing a two component developer material and having a reciprocating carriage for carrying an original document across the illuminating means, an endless, reusable photoconductor, the photoconductor rotating through two cycles for each copy produced of an original document and having a seam extending across the width thereof and a total length less than the length of the document to be imaged and the length required for the physical location of all the photocopying process elements other than the transfer apparatus, a corona device for discharging electrical charge that may remain on the photoconductor after the developed image has been transferred from the photoconductor, a magnetic brush developing device for developing the latent image on the photoconductor and removing untransferred developer material from the photoconductor, and a common source of internally generated voltage for both the discharging corona and the magnetic brush developing device bias voltage, wherein the bias voltage for the magnetic brush developing device is terminated when the voltage to the discharging corona is terminated. The improvement, an arrangement of electrical components, reduces the non-uniformity of the charge deposited on the photoconductor to thereby increase the functional life of the photoconductor while substantially maintaining the bias voltage during interruption of voltage to the discharging corona.

8 Claims, 2 Drawing Figures

BIAS VOLTAGE CONTROL FOR ELECTROPHOTOCOPIER MAGNETIC BRUSH

BACKGROUND OF THE INVENTION

The instant invention relates to magnetic brush development devices in electrophotocopying machines, and more particularly to controlling the bias voltage on the magnetic brush development device and the charging of the photoconductor in a compact electrophotocopying machine utilizing a two-component developer material.

Plain paper electrophotocopying machines are well known devices that reproduce images of original documents on ordinary or plain paper. Such machines typically include a re-usable photoreceptor including a conductive substrate coated with a photoconductive material, a supply of plain paper copy sheets, and a plurality of processing stations for operating on the photoconductor and the copy sheets. In a typical sequential copying process, the photoconductor in uniformly charged and then exposed to an illuminated, original document. The areas of the photoconductor that are struck by the image of the indicia carried on the original retain their charge and the charge in the light-struck areas is dissipated. Thus a latent electrostatic image is formed on the photoconductive coating of the photoconductor. The latent image is then developed by contacting the photoconductor with electrostatically attractable, two component developer material which adheres to the charged areas of the photoconducting coating that make up the latent image. The toned image is next transferred to the copy sheet where the toner is fused onto the sheet to fix the image thereon.

Early models of plain paper copiers were large in size because they used either a relatively large radius drum for supporting a photoconductor or a belt or web type photoconductor that moved through an elongated path past the copy processing stations. Unfortunately, such machines are not practical for some users who have a limited amount of office space or modest copying requirements.

Accordingly, the size of plain paper copiers in many instances has been reduced in order to meet the spatial and economic requirements of the relatively low volume user who desires plain paper copies. However, these compact, plain paper copiers with unity magnification pose additional problems, one of which comes about when the length of the photoconductor (which may be reduced in order to provide a compact, plain paper copier) is less than the length of the longest document to be imaged plus the length required for the physical location of all the photocopying process elements other than the apparatus for transferring the latent image from the photoconductor to a copy sheet (typically the transfer corona). Although the magnetic brush is utilized for for both development of the latent image as well as cleaning of the untransferred toner there is not enough space along the periphery of the short photoconductor used in this compact copier to physically locate all the photocopying process elements other than the transfer apparatus. The result is that the photoconductor is required to rotate through two cycles for each desired copy of an original document. A typical plain paper copier employs corona devices for charging and discharging the photoconductor and for transferring the toned image on the photoconductor to the copy sheet. However, when the photoconductor is caused to pause in its movement in order to let the rest of the photocopier cycle synchronize to the photoconductor movement, the discharging corona can permanently damage the photoconductor. Accordingly, the power supply to the discharging corona is terminated when the clutch driving the photoconductor is disengaged from the photoconductor.

Some compact, plain paper copiers which function as described above, are provided with a common, internally generated source of voltage for the magnetic brush developing device bias voltage and the discharging corona because they are operated simultaneously, thereby allowing the cost of the machine to be reduced. However, when the common source of voltage to the discharging corona is terminated to prevent permanent damage to the photoconductor, the magnetic brush developing device bias voltage is also terminated, which results in a small band of undesirable background across the copy sheet. The instant invention provides an improvement to reduce the nonuniform photoconductor damage caused by the discharging corona and to maintain constant the bias voltage associated with the magnetic brush developing device to overcome the aforementioned undesirable background.

SUMMARY OF THE INVENTION

The instant invention is an improvement in an electrophotocopying machine utilizing a two component developer material and having a reciprocating carriage for carrying an original document across the illuminating means, an endless, re-usable photoconductor, the photoconductor rotating through two cycles for each copy produced of an original document and having a seam extending across the width thereof and a total length less than the length of the document to be imaged plus the length required for the physical location of all the photocopying process elements other than the transfer apparatus, a corona device for discharging electrical charge that may remain on the photoconductor after the developed image has been transferred from the photoconductor, a magnetic brush developing device for developing the latent image on the photoconductor and removing untransferred developer material from the photoconductor, and a common source of internally generated voltage for both the discharging corona and the magnetic brush developing device bias voltage, wherein the bias voltage for the magnetic brush developing device is terminated when the voltage to the discharging corona is terminated. The improvement reduces the non-uniformity (thereby increasing uniformity) of the charge deposited on the photoconductor to thereby increase the functional life of the photoconductor while substantially maintaining the bias voltage during interruption of voltage to the discharging corona. The improvement comprises a switch on the input to the common source of internally generated voltage, the switch being opened simultaneously with the disengagement of the clutch controlling the photoconductor motion to thereby terminate the common souce of internally generated voltage, means operatively connected to the common source of internally generated voltage for providing the bias voltage, a charge retaining element connected in parallel to the means providing the bias voltage, and a one way, electrical valve operatively connected to the input for the charge retaining element and the bias voltage elements, wherein the charge retaining element substantially maintains the bias voltage when the common source of voltage is terminated.

DETAILED DESCRIPTION

Figure 1:
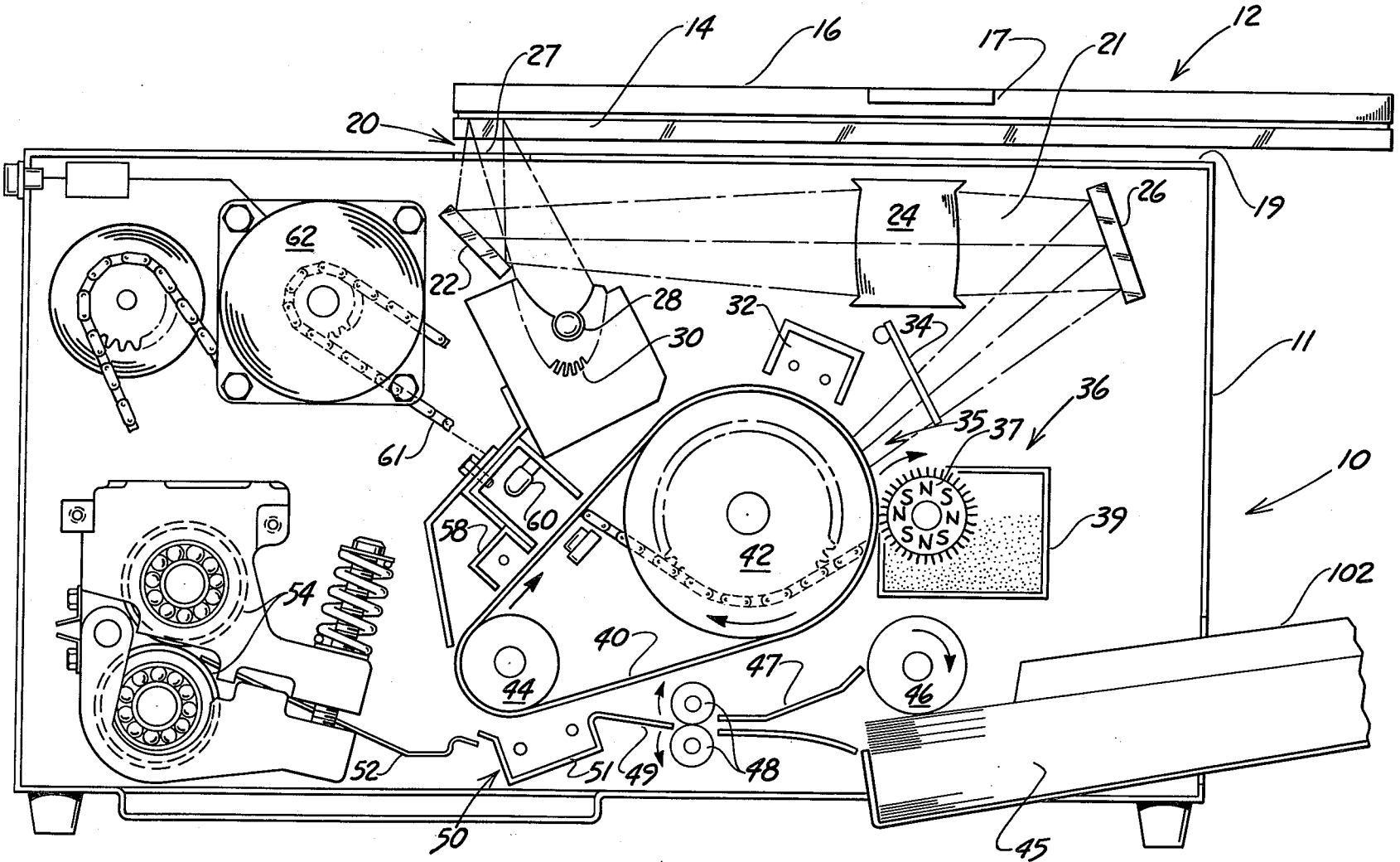
FIG. 1 is a schematic elevation of an electrophotocopying machine according to the instant invention.

In describing the preferred embodiment of the instant invention, reference is made to the drawings wherein there is seen in FIG. 1 a compact copier generally designated 10 having a rectangular, reciprocating carriage 12 that is movably mounted on top of a cabinet 11. The carriage 12 includes a transparent platen 14 on which documents are placed face down for copying. Overlying the platen 14 is an opaque, movable cover 16 which has a white surface juxtaposed to the platen 14. The cover 16 is connected to one side of the carriage 12. In the preferred embodiment, the cover 16 is made of relatively flexible material that is connected by a hinge to one of the longer sides of the carriage 12. The cover 16 has a handle 17 disposed opposite to the hinged side of the cover 16. An operator can manipulate the handle 17 in order to raise and lower the cover 16 and thereby place documents on or remove documents from the platen 14.

The carriage 12 is shown in FIG. 1 in its extreme right or home position. During a copy cycle, the carriage moves to the left a predetermined distance that is long enough to enable the copier 10 to make copies of 14 inch long documents. Underneath the carriage is an illuminating station, generally indicated at 20, which includes a relatively narrow opening 27 that extends across the width of the upper surface 19 of the cabinet 11. A light source is operatively disposed underneath the opening 27 and comprises a lamp 28 axially aligned and partially surrounded by a shaped reflector 30 which serves to direct and focus the light from the lamp 28 toward the opening 27. As the carriage moves from right to left, a document on the carriage passes over the opening 27 and is illuminated by the light from the lamp 28. In other words, the document is scan exposed across the illuminating station 20.

An image of the document is transmitted to a photoconductor belt 40 at an imaging station generally designated 35. The image is transmitted along a Z-shaped path by an optical system 21 comprising tilted mirror 22 and 26 and a lens 24. The mirror 22 receives an image of the illuminated document as the latter passes over the window 27. The mirror 22 reflects the image toward the lens 24 which is focused upon the second tilted mirror 26 which in turn reflects the focused image onto a portion of the photoconductor belt 40 at the imaging station 35. The photoconductor belt 40, 18 inches long in the preferred embodiment, is moved through the imaging station at a predetermined speed by a drive roller 42 in synchronism with the movement of the carriage 12 across the illuminating station 20. The motive power for turning the drive roller 42 is supplied by a main motor 62 through a suitable drive system that includes drive chain 61 (partially shown) and a clutch (not shown). The chain 61 also drives other elements including the magnetic brush 37, the carriage 12, the feed and queuing rollers 46 and 48, control cams (not shown) and the fixing rollers 54.

An idler roller 44, relatively small in comparison to the drive roller 42, also supports and tensions the photoconductor belt 40. The belt 40 itself comprises an outer photoconductive layer, preferably a formulation including zinc oxide (ZnO) that is coated on a conductive substrate, preferably one made of metalized polyester film, such as Mylar brand film with an aluminum base.

Disposed around the periphery of the photoconductor belt 40 are a number of the operating components of the copier 10. In particular, the two-wire corona charging unit is juxtaposed to the photoconductor belt 40 at approximately a 1 o'clock position with respect to the drive roller 42. The charging unit 32 is operable to impart a uniform electrostatic charge to the ZnO surface of the photoconductor 40. The drive roller 42 turns in a clockwise direction so that the uniformly charged surface of the photoconductor belt 40 moves from the charging unit 32 toward the imaging station 35. A blade-like shutter 34 is operatively associated with the imaging station 35. The shutter 34 is movably mounted in the copier 10 in order to adjust the amount of light that strikes the photoconductor 40 at the imaging station 35. In accordance with the well-known photocopying technique, the light-struck areas of the photoconductor belt 40 are electrically discharged, thereby leaving a latent (undeveloped) electrostatic image that corresponds to the indicia areas (printed portions) of the document that is to be copied.

Figure 2:
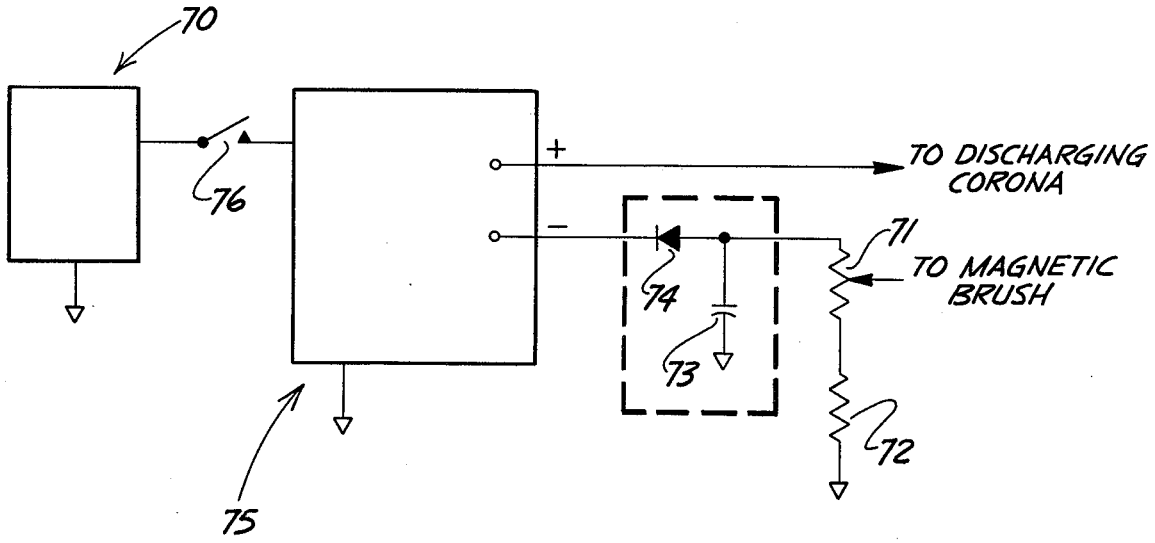
FIG. 2 is a diagram of an improved electrical circuit according to the instant invention, the improvement being shown within the dashed lines.

As the drive roller 42 turns, the latent image on the photoconductor belt 40 is carried past a magnetic brush developer device 36 disposed at a 3 0'clock position with respect to the drive roller 42. The developing device 36 includes a hopper 39 for holding a supply of two component developer material consisting of particulate iron materials and pressure fixable marking material. The magnetic brush 37 picks up developer material from the hopper 39 and carries that developer materials into contact with the photoconductor 40. A potentiometer 71 (FIG. 2) provides a means for adjusting the negative D.C. bias voltage to the magnetic brush developing device 36. The charged or latent image areas of the photoconductor 40 electrostatically attract and hold developer particles, thus developing the latent image.

The toned or developed image leaves the developer station 36 and moves toward the transfer station 50 where there is a two-wire corona transfer charging apparatus 51. In timed relationship with the arrival of the toned image at the transfer corona 51, a copy sheet fed from a supply of sheets 45 stored in a removable tray 102 also arrives at the transfer station 50. The feed roller 46 feeds the uppermost copy sheet from the supply 45, through a paper guide 47 and into the nip of the queuing rollers 48. At a predetermined time in the course of a copy cycle, the queuing rollers 48 are actuated to feed the copy sheet along a paper guide 49 and into contact with the developed image carried on the photoconductor belt 40. By virtue of the electric charge that is generated by the transfer corona 51, toner particles are attracted from the photoconductor belt 40 toward the copy sheet to which they loosely adhere.

The copy sheet is separated from the photoconductor belt 40 by the interaction of the small diameter idler roller 44 with the relative stiffness of the copy sheet. In other words, as the photoconductor passes around the idler roller 44, the copy sheet does not follow the belt 40. Instead, the leading edge of the copy sheet moves away from the belt along a path that is initially tangent to the idler roller 44. The copy sheet is ultimately guided by a paper guide 52 into the nip of pressure fixing rollers 54. Under the influence of the high pressure exerted on the pressure fixable toner by the rollers 54, the image is permanently fixed to the copy sheet as it passes through the fixing rollers 54 and into a receiving tray not shown.

After the developed image is transferred, a residual latent electrostatic image and some untransferred toner remain on the photoconductor belt 40. As the belt 40 continues along its path, it is carried past a single wire discharge corona 58 which neutralizes any charge on the untransferred toner. Next, the belt 40 passes underneath an array (preferably four) of incandescent erase lamps 60. Light from the erase lamps 60 illuminate the belt 40, discharge the residual latent image areas of belt 40, and thereby erase any remaining residual electrostatic image.

As the photoconductor belt 40 begins its second cycle, the carriage 12 starts to return from its extreme left position toward its extreme right or home position. During the second cycle, the corona charger 32 and the transfer corona 51 are de-actuated. By virtue of the effects of the erase lamps 60 and discharge corona 58, the untransferred toner is now only loosely adhering to the photoconductor belt 40. As the transfer toner passes the magnetic brush 37 the latter attracts the untransferred toner from the belt 40 onto the magnetic brush 37. Hence, the magnetic brush 37 performs two functions: on the first cycle the magnetic brush 37 develops the latent electrostatic image and on the second cycle the magnetic brush 37 cleans the photoconductor of any untransferred toner. Thus, after the second cycle, the photoconductor belt 40 is cleaned of toner and ready to make another copy.

A common power supply 70 (see FIG. 2) provides the input power to a high voltage, internally generated power supply 75 having a multiplicity of outputs. The input power is switched on through switch 76 only when the clutch operating the photoconductor drive mechanism is actuated, thereby providing output voltages to operate the discharging corona 58 and the magnetic brush bias circuit only when the photoconductor 40 is being positively driven. During the period when the switch 76 is closed, the diode 74 allows the capacitor 73 to charge as well as conducts current to the potentiometer 71, the resistor 72, and the magnetic brush developing device 36. The bias voltage applied to the magnetic brush 37 is adjusted by the potentiometer 71 to the required value. When the switch 76 is open the discharge corona current drops to nil but the charge stored in the capacitor 73 provides the current required to substantially maintain the bias voltage for a short period of time. The diode 74 also prevents the flow of current though the internal impedance of the power supply 75.

While this invention has been described with reference to the structure disclosed herein, it is not confined to the details set forth, and this application is intended to cover such modifications or changes as may come within the purposes of the improvements of the scope of the following claims.

What is claimed is:

1. In an electrophotocopying machine utilizing a two component developer material and having a reciprocating carriage for carrying an original document across the illuminating means, an endless re-usable photoconductor, said photoconductor rotating through two cycles for each copy produced of an original document and having a seam across the width thereof and having a total length less than the length to be imaged plus the length required for the physical location of all the photocopying process elements other than the transfer apparatus, a corona device for discharging electrical charge that might remain on the photoconductor after the developed image plus been transferred from the photoconductor, a magnetic brush developing device for developing the latent image on the photoconductor and removing untransferred developer material from the photoconductor, and a common source of internally generated voltage for both the discharging corona and the magnetic brush developing bias voltage, wherein the bias voltage for the magnetic brush developing device is terminated when the voltage to the discharging corona is terminated, an improvement for reducing the non-uniformity of charge deposited on the photoconductor to thereby increase photoconductor life while substantially maintaining the bias voltage during interruption of voltage to the discharging corona, said improvement comprising:

a switch on the input to the common source of internally generated voltage, said switch being opened simultaneously with the disengagement of the clutch controlling the photoconductor motion ot thereby terminate the common source of internally generated voltage;

means operatively connected to the common source of internally generated voltage for providing the bias voltage;

a charge retaining element connected in parallel to the means providing the bias voltage; and a one way electrical valve operatively connected to the input for the charge retaining element and the bias voltage means, said charge retaining element substantially maintaining the bias voltage when the common source of voltage is terminated.

2. The improvement of claim 1, wherein the charge retaining element is a capacitor.

3. The improvement of claim 2, wherein the means providing the bias voltage comprises a potentiometer.

4. The improvement of claim 3, wherein the one way electrical valve comprises a diode.

5. The improvement of claim 4, wherein the total length of the photoconductor is about 18 inches.

6. The improvement of claim 4, wherein the photoconductor comprises a belt.

7. The improvement of claim 6, wherein the photoconductive layer of the belt comprises a formulation including zinc oxide.

8. The improvement of claim 7, additionally comprising a large roller to drive the photoconductor belt and a small, idler roller to support and tension the photoconductive belt.

* * * * *